US005726104A

United States Patent [19]

Hannawacker et al.

[11] Patent Number: 5,726,104

[45] Date of Patent: Mar. 10, 1998

[54] LIGHT-ADMITTING COMPONENT AS RIGID ROOFING

[75] Inventors: Dieter Hannawacker, Glattbach; Klaus Oberländer, Hanau; Norbert Brand, Darmstadt; Dieter Bettinger, Freigericht, all of Germany

[73] Assignee: AGOMER Gesellschaft mit beschrankter Haftung, Hanau, Germany

[21] Appl. No.: 741,033

[22] Filed: Oct. 30, 1996

Related U.S. Application Data

[63] Continuation of Ser. No. 496,244, Jun. 28, 1995, abandoned.

[30] Foreign Application Priority Data

Jul. 4, 1994 [DE] Germany ..... 44 23 154.7

[51] Int. Cl.[6] ..... B32B 27/00

[52] U.S. Cl. ..... 442/286; 442/287; 442/288; 442/394; 442/395; 442/396; 52/200; 52/DIG. 17

[58] Field of Search ..... 52/200, DIG. 17; 442/287, 288, 286, 394, 395, 396

[56] References Cited

U.S. PATENT DOCUMENTS

| | | | |
|---|---|---|---|
| 4,565,723 | 1/1986 | Hirsch | 428/71 |

FOREIGN PATENT DOCUMENTS

| | | |
|---|---|---|
| 109388 | 5/1984 | European Pat. Off. . |
| 353397-A | 2/1990 | European Pat. Off. . |
| 40 42 265 A1 | 7/1992 | Germany . |
| WO 92/09760 | 6/1992 | WIPO . |

*Primary Examiner*—Christopher Raimund
*Attorney, Agent, or Firm*—Cushman Darby & Cushman, IP Group of Pillsbury Madison & Sutro LLP

[57] ABSTRACT

A light-admitting plastic sheet component is used for rigid roofing. PVC or PC is chosen as the material for the plastic sheet, and the side not exposed to weathering is coated with a non-combustible material that is resistant to flying sparks and radiant heat.

21 Claims, No Drawings

LIGHT-ADMITTING COMPONENT AS RIGID ROOFING

This is a continuation of application Ser. No. 08/496,244, filed on Jun. 28, 1995, which was abandoned upon the filing hereof.

BACKGROUND OF THE INVENTION

1. Field of the Invention

The invention relates to the use of a light-admitting component, wherein the component is based on the generally known compact or hollow-chamber sheets, particularly double webbed sheets.

In particular, the invention relates to the use of components comprising a sheet of PVC or PC having an under side and an upper side exposed to weathering, which sheet has a coating with a non-combustible material that is resistant to flying sparks and radiant heat.

2. Prior Art

FR-A-1 403 655, DE-A-33 00 408, DE 93 17 460 U1, EP-A-0 109 388, and EP-A-0 353 397 = DE-A-38 24 077 are cited in respect of the prior art.

A so-called light-admitting sandwich sheet is known from FR-A-1 403 655, the core of which is composed of hollow fibres arranged parallel to one another made of thermoplastics. A thin film arranged vertically to said core covers the upper and lower open ends of the fibres. A further layer situated on said film, composed of a mixture of plastic material and glass fibres, provides the strength of the component.

DE-A-33 00 408 discloses a layer arrangement for a light-admitting and heat-insulating covering of buildings, wherein a plastic body on the inside opposite the space to be covered is provided with a thin glass sheet. Suitable arrangements are e.g. hollow-chamber sheets, for example, made of polycarbonate, the inside of which is laminated with a thin glass sheet with the aid of strips of sliding means made of PTFE, the strips of sliding means being laid only in the region of the supporting bed of the supports or glazing bars. A relative movement of plastic body and glass sheet is thereby made possible. The overall layer arrangement serves mainly to prevent unwanted formation of water droplets which otherwise occurs on plastic bodies.

A process is provided by DE 93 17 460 U1 for the production of light-admitting components in which a glass pane is provided with a PUR heat sealing film and subsequently bonded in a durable manner with the under side of a further glass pane using pressure and heat. This is a burglar-proof automobile glass pane made of laminated composite glass.

A plastics webbed sheet is described in EP-A-0 109 388, in which a reinforcing layer made of a different plastic to the plastic material of the webbed sheet is applied to at least one of its two sides with the aid of a levelling layer.

None of said components is known to be suitable as "rigid roofing", however, unlike the component known from EP-A-0 353 397.

The term "rigid roofing" is explained in more detail in the regional building regulations and in the recommendations for the use of combustible building materials. Accordingly, a roofing is rigid if the component to be used as roofing skin is resistant to a defined extent to flying sparks and radiant heat. The extent is defined by the test according to DIN 4102, Part 7 "Rigid roofing".

When the test is carried out, a defined quantity of woodwool is ignited on the upper side of the sheet exposed to weathering. In order to pass DIN 4102, Part 7, no flames must occur on the under side, i.e. the side of the sheet turned away from weathering, burning parts must not drip off, and the roof surface must remain closed to such an extent that burning or glowing parts cannot fall through the roofing or a continuous load-bearing sub-structure. Holes up to 0.25 $cm^2$ in area—totalling up to 45 $cm^2$ in area for each test site—are permissible if the distance between the edge of one hole and another is at least 1 cm.

The component known from EP-A 0 353 397 in which a webbed sheet of polymethylmethacrylate, polycarbonate or PVC is coated on the upper side with a glass fibre fabric passes the test according to DIN 4102 because the fabric which, in the case of sheets arranged with the coated side facing outwards, is situated on the side exposed to weathering, prevents the fire spreading downwards, whilst the part of the sheet lying under the seat of the fire becomes plastic. Said part distorts downwards and is thereby removed from the fire.

Moreover, the component of EP-A-0 353 397 is also said to combine the following properties:

Light-admitting, >40%

Heat-insulating, k values of 2.8 $W/m^2K$ and better, depending on the sheet geometry Can be laid over large areas. Formats of 1.2×10 m can be produced without difficulty. Larger formats can be produced.

Depending on the material used (plastics), can undergo cold bending or thermoplastic forming Resistant to weathering In the event of fires inside the building, the roof surface covered with said components opens and allows smoke to escape.

It has emerged in practice that the known component may, in principle, fulfil the requirements mentioned but that it needs further improvement, at least in terms of some of the properties listed.

A very serious disadvantage of the known component lies, for example, in the fact that the bond of the glass fabric with the upper side of the plastics part is not yet sufficiently durable over a long period of weathering. The glass fabric coating absorbs a relatively large amount of moisture in view of its wick effect, as a result of which signs of delamination may occur between plastic sheet and coating. Although a weakened bond may, in principle, be stabilized with adhesion promoters, a modification of the fabric required for this purpose is not sufficient on the whole because it should, in addition, have anti-adhesive surfaces and hydrophobic properties.

Moreover, tensions between sheet and coating may occur not only because of moisture absorption but also because of temperature differences between the inside and the outside.

In both cases, however, in the event of a fire, the extinguishing water may pass through the weakened component into a building roofed therewith.

In addition, the glass fibre top layer becomes soiled very quickly because it is relatively rough.

In view of the disadvantages described above, the component described in EP-A-0 353 397 has not been used commercially hitherto.

SUMMARY OF THE INVENTION

In view of the disadvantages inherent in the components known in the prior art, the object of the present invention is to use the components inherently known from EP-A-0 353

397 for "rigid roofing" in such a way that the "rigid roofing" becomes more resistant to weathering and, moreover, the risk of penetration by extinguishing water in the event of a fire is substantially reduced.

These objects not mentioned in further detail are achieved with the use of the light-admitting component for rigid roofing wherein a sheet of polyvinyl chloride (PVC) or polycarbonate (PC) having its upper side exposed to weathering, is provided on its underside with a coating of non-combustible material that is resistant to flying sparks and radiant heat.

Due to the fact that the plastic chosen for the sheet is polycarbonate (PC) or polyvinyl chloride (PVC) and that the side of the plastics sheet that is not exposed to weathering is coated, decisive advantages are achieved which make the light-admitting component according to the invention for rigid roofing superior to the component known from EP-A-0 353 397.

The non-combustible coating which is resistant to flying sparks and radiant heat is exposed only to a very small extent to weathering, or not at all; costly modifications to the coating may be unnecessary or reduced accordingly; adhesion problems due to moisture absorption (wick effect) during external weathering are minimized; the bond of the plastics sheet with the coating is easy to produce and the requirements in respect of DIN 4102 are also fulfilled over a relatively long period without any substantial deterioration of the light-admitting component for rigid roofing.

DETAILED DESCRIPTION OF THE INVENTION

The plastic sheets to be used according to the invention as a constituent of the light-admitting component for rigid roofing are, in principle, well known to the expert. They are the well known compact sheets of solid design or hollow-chamber sheets which may have webs inside in various arrangements in order to reduce the weight whilst at the same time guaranteeing stability. The sheets to be mentioned are, inter alia, the webbed sheet, the double webbed sheet or the so-called framework sheet. The compact sheet and the framework sheet are particularly preferred within the scope of the invention.

All plastics from which light-admitting sheets with the necessary fire properties can be produced are suitable as plastics materials of which the sheets may be composed. Types of plastic which can be classified in fire class B1 (difficultly flammable) in accordance with DIN 4102 are particularly advantageous. Plastics that fulfil these requirements include, inter alia, polycarbonate (PC) and polyvinyl chloride (PVC). Within the meaning of the invention, polycarbonate or polyvinyl chloride means not only the homopolymer but also all the co- and terpolymers which have a predominant proportion of polycarbonate or polyvinyl chloride units in addition to other structural units, and other physical mixtures, i.e. blends of two or more of the above-mentioned components, and corresponding polymers which are obtainable from the molding compounds containing predominantly the above-mentioned components and customary processing and modifying compounds.

Polycarbonate or polyvinyl chloride sheets are particularly preferred in the invention.

Acrylic glass sheets, particularly those comprising predominantly polymethylmethacrylate are less expedient for the invention since they are flammable in direct contact with flying sparks, which may lead to them failing the test according to DIN 4102, Part 7.

The plastics sheets which form the basis of the light-admitting component according to the invention generally have an upper and an under side. Within the scope of the invention, upper side is taken to mean the side facing outwards when the sheet is installed, and turned towards weathering, whilst the under side is always turned away from weathering. In contrast to the well known component in which the coating of necessity faced outwards, the under side of the sheet according to the invention which is not exposed to weathering is provided with a fire-resistant coating. This may be non-combustible woven fabrics, knitted fabrics, random-orientation fabrics or non-wovens, woven fabrics or non-wovens being particularly preferred according to the invention.

These are composed preferably of glass fibres and advantageously have a weight per unit area of 40 to 600 g/m$^2$, preferably 80 to 220 g/m$^2$ (fibre weight).

It has proved advantageous to use closely woven fabrics. The woven fabric, knitted fabric, random-orientation fabric or non-woven may also be composed of other materials apart from glass fibres, such as e.g. asbestos, mineral fibres and metals.

It is crucial for their applicability that they be non-combustible and do not completely remove the light transmission of the sheets to be coated.

The woven fabrics are advantageously coated or impregnated, at least on the side with which they are to adhere to the sheets serving as the basic structural element, with a layer of thermoplastic, particularly acrylate, polyurethane or PVC. Moreover, the side of the component exposed to weathering may be laminated preferably with a film generally known to be weather-resistant, particularly PTFE or PVF. If desired, the coating, particularly the woven fabric or non-woven, may also be laminated with such a weather-proof film, namely on the side of the coating facing away from the component. It is, however, far preferable for the side of the coating facing away from the component to be laminated with a film generally known to be anti-adhesive, particularly of PTFE or PVF. Advantageously, the coating of the component may also contain flame retardant substances.

When producing the components, it is preferable to proceed in such a way that the non-combustible woven fabric, knitted fabric, random-orientation fabric or non-woven which is composed in particular of glass fibres is fed into the calibration unit during the production of the sheets which takes place in a generally known way, and is bonded to the under side of the sheets. The term calibration unit is understood to mean a device for exerting a molding force which is arranged after the actual extrusion with the purpose of holding the plastic synthetic material in the desired form until the temperature falls below the glass temperature.

Naturally, the various woven fabrics, knitted fabrics, random-orientation fabrics or non-wovens described above are used in the process. If necessary, an additional adhesive, e.g. an acrylate adhesive, is used for fixing.

The bond may also, however, be produced by generally known methods after the sheet has been produced e.g. by bonding the coated woven fabric etc. with an acrylate adhesive (e.g. Agovit®: cold setting adhesive on an acrylate basis).

The preferred procedure within the scope of the invention is that the non-combustible coating material is provided with a PUR heat sealing film and is subsequently bonded in a durable manner with the under side of the sheet using pressure and heat.

As a result of the simple measures described above, the sheets used as the basic element of the components according to the invention (hollow-chamber and compact sheets) pass the test according to DIN 4102, Part 7 "Rigid roofing" and at the same time are improved in terms of their fatigue strength. This is also apparent in particular from the increased resistance to weathering of the bond.

As already explained above, a defined quantity of wood (wool or pieces of wood) is ignited on the outside of the component in said test.

The coated surface in this case is situated on the under side of the component and is therefore exposed only to a very minor extent to weathering, if at all. The woven fabric prevents the fire spreading downwards. The part of the component lying beneath the seat of the fire plastifies in the process. Flames do not occur on the under side. Burning parts do not drip and the roof surface remains closed.

The components according to the invention are installed according to generally known methods. They are installed with the coated sides facing downwards. This particular arrangement results in the advantages already mentioned for the components according to the invention, which make the component suitable for use as "rigid roofing", particularly as there is no restriction on the component according to the invention in terms of particular geometries or color.

The invention is described in more detail below on the basis of examples of execution and comparison examples not according to the invention.

The meanings in the examples and comparison examples are:

| | | |
|---|---|---|
| Decarglas ® | = | polycarbonate sheet from Degussa |
| PUR heat sealing film | = | polyurethane heat sealing film |
| PTFE coating | = | coating based on polytetrafluoro-ethylene |
| Deglas ® | = | sheet based on acrylic glass from Degussa |
| Agovit ® 1900 | = | cold-setting adhesive for acrylic glass bonds |
| PVF film | = | polyvinyl fluoride film |
| SDP | = | double webbed sheet |
| FWP | = | framework sheet |
| TMT 1614, 1615 1617, 1618 | = | modified glass fabric (coated with acrylate film); difference according to the degree of closeness of the weave) |

EXAMPLES

A) Production of light-admitting components according to the invention

Example 1

A glass fabric (200 g/m$^2$) is applied with the aid of a transfer adhesive tape e.g. Isotac/3M to the underside of a Decarglas® webbed double sheet, 16 mm, colorless.

Example 2

As example 1, but with glass fabric (300 g/m$^2$).

Example 3

As example 1, but a PUR heat sealing film is used for application using pressure (3 bar) and heat (130° C.) instead of an adhesive tape.

Example 4

A self-adhesive PTFE-coated glass fabric is applied to the under side of a Decarglas® compact sheet, 3 mm, colored.

Example 5

A self-adhesive PTFE-coated glass fabric is applied to the under side of a Decarglas® double webbed sheet, 16 mm, colored.

Example 6

A glass fabric (200 g/m$^2$) is applied with the aid of a PUR heat sealing film using pressure (3 bar) and heat (130° C.) to the under side of a Decarglas® compact sheet 3 mm.

All the components produced, as described in examples 1–6, fulfil the requirements according to DIN 4102, Part 7, and have the other properties listed as being desirable in the statement of the object.

Comparison Example 7

The upper side of a Deglas® double webbed sheet 16 mm, colorless, is laminated with glass fabric (plain weave formation, 44 g/m$^2$) with 400 g of Agovit 1900®.

A top layer of 400 g/m$^2$ Agovit 1900® is applied thereto. 10% flame retardant Fyrol CEF [tis (β-chlorethyl) phosphate] is added to the Agovit.

Comparison Example 8

As comparison example 7 but with glass fabric, plain weave formation, 270 g/m$^2$.

Comparison Example 9

As comparison example 7, but with glass fabric, plain weave formation, 600 g/m$^2$.

Comparison Example 10

During the production of a double webbed sheet 16 mm, an acrylate-coated glass fabric, total weight 270 g/m$^2$, is introduced into the calibration unit and thereby bonded to the surface of the upper side of the webbed sheet. Adhesion 2 kg/5 cm.

Comparison Example 11

As comparison example 10, but a PVC-coated glass fabric, total weight 770 g/m$^2$ is introduced. The upper side of the fabric coated on both sides is laminated with a PVF film 25 m thick. The adhesion on the webbed sheet is 17 kg/5 cm.

All the components described in comparison examples 7–11 also fulfil the requirements according to DIN 4102, Part 7.

B) Fire behavior

Comparison Example 12

A Deglas® SDP sheet, white, opalescent, which was provided with an outer coating by introducing a glass fabric TMT 1614 from Hornschuch into the calibration unit underwent the fire test according to DIN 4102, Part 7 at an angle of 15° and an ambient temperature of 19° C. The sheet withstood the "Rigid roofing" test, the under side of the sheet opened after 3 minutes and no burning drops of material could be observed. The fire test was stopped after 8 minutes.

Comparison Example 13

As comparison example 12, but Deglas® SDP 21110 was used as support material and a material from Hornschuch with the name TMT 1615 was used as woven fabric on the upper side. The material used did not pass the "Rigid roofing" fire test, the under side opened after only 3.5 minutes and flame penetration and blistering of the heated material were observed. There were no burning drops, however. The test was stopped after 9.5 minutes.

Comparison Example 14

As comparison example 13, but with the difference that a material from Hornschuch with the abbreviated name TMT 1617 was used as woven fabric coating. In the fire test, the under side of the tested sheet opened after 4.5 minutes; blistering occurred and burning drops were observed. The test was stopped after 8 minutes. The sheet did not pass the "Rigid roofing" test.

Comparison Example 15

As comparison example 14, but with the difference that a material from Hornschuch TMT 1618 was used as coating of the outside. After a 4 minute fire, there was slight opening of the under side; blistering was observed, but no burning drops. The test was stopped after 8 minutes; the sheet examined passed the "Rigid roofing" test well.

Comparison Example 16

A material underwent the fire test according to DIN 4102, Part 7 which, as support, was composed of an acrylic glass sheet SDP, normal chamber, transparent, and which had on its upper side a woven fabric coating of PTFE which had a brownish Flontex AP type 1080/40 on the upper side. In the fire test, the thermoplastic slowly distorted away from the seat of the fire after 3 minutes 15 sec. Blistering and opening of the under side were observed after about 5 minutes. The fire test was stopped after 10 minutes. The sheet passed the "Rigid roofing" test according to DIN 4102, Part 7.

Example 17

A sheet according to the invention made of Decarglas® FWP which was laminated on its under side with a glass fabric, the bond having been created by an adhesive film from 3M, underwent the fire test according to DIN 4102, Part 7. Due to the fact that the woven fabric had been applied to the side of the support material facing away from weathering, the polycarbonate plastified in the fire test due to heat development and began to burn in places (with a smoking flame). No opening of the under side was observed, though plastified material did drip in places. After about 10 minutes, no spreading of the fire was to be seen on the surface of the framework sheet, which is due to the self-extinguishing property of polycarbonate. Rather, the fire was seen to go out slowly. The plastified polycarbonate solidified on the fabric, the glass fabric was almost completely covered with polycarbonate material. On the whole, no opening of the component was observed, nor blistering due to distorting thermoplastic on the under side. The sheet according to example 18 passed the test according to DIN 4102, Part 7, "Rigid roofing".

Example 18

As example 17, but with the difference that the under side was coated with PTFE glass fabric Flontex AP, self-adhesive. As in example 17, no dripping of plastified material was observed. The under side remain closed. The test was stopped after 14 minutes; the "Rigid roofing" test was passed.

Comparison Example 19

A Decarglas® compact sheet without modification of the under side underwent the fire test. Plastification of the polycarbonate occurred from the seat of the fire outwards and the under side was torn open and burning material dripped off the sheet. The fire test was stopped after 3 minutes with the result that without the glass fabric coating or modification of the support, the "Rigid roofing" fire test was not passed.

Example 20

As comparison example 19, but the support material was modified on the under side with a Flontex PTFE AP fabric from Hornschuch, self-adhesive.

After the fire load was applied, the sheet bulged upwards, the thermoplastic plastified and no burning drops were observed. The plastified polycarbonate solidified on the upper side of the fabric, no blistering was observed on the under side. As a result, the "Rigid roofing" fire test according to DIN 4102, Part 7 was passed.

Example 12

A Decarglas® framework sheet (16 mm) which was provided on the under side with a glass mat from Schuler DH 120 (120 g/m$^2$) was tested. The glass mat was applied with an adhesive Agovit® 1900.

In the fire test, dripping of plastified material was observed, but said material was Agovit® which did not burn. During the course of the fire test, no spreading of the fire on the surface of the framework sheet was observed; after the fire load finished burning (woodwool), the polycarbonate extinguished itself, the under side of the framework sheet remained closed. As a result, the "Rigid roofing" test was passed.

Example 22

As example 21, but with the difference that a Decarglas® compact sheet with glass mat from Schuler DH 120 (120 g/m$^2$) applied to the under side with Agovit 1900 was used. The test procedure was similar to that of the previous test, the glass mat becoming particularly solid. In view of the result, example 22 is also a "Rigid roofing" according to DIN 4102, Part 7.

Example 23

As example 22, but with the difference that the Decarglas® framework sheet 16 with a glass mat from Schuler SM 50 (50 g/m$^2$) applied to the under side with Agovit® 1900 underwent the fire test. The glass mat solidified during the fire test, plastified material was seen to drip (non-combustible Agovit® 1900). The under side of the framework sheet remained closed. In view of the result this is a "Rigid roofing" according to DIN 4102, part 7.

Example 24

As example 23, but with the difference that in order to modify the supporting framework sheet made of Decarglas®, a glass mat from Schuler SM 70 (70 g/m$^2$) was applied to the under side of the framework sheet with Agovit® 1900. In the fire test, the glass mat solidified, drops of plastified material were observed (Agovit® 1900—non-combustible). The under side of the framework sheet remained closed, and the result was "Rigid roofing" according to DIN 4102, Part 7.

Comparison Example 25

A Deglas® double webbed sheet (SDP sheet) which was provided on the outside with a woven fabric coating, this being a glass fibre fabric with PVC coating and acrylic lacquer coating on one side (material from Hornschuch, type designation TEB 1525) was exposed to fire according to the DIN standard 4102, Part 7. The inclination of the sheet was 15° and the other conditions corresponded to those in comparison example 12.

The sheet opened after a fire of 7 minutes' duration, the fire test was stopped after 15 minutes. The "Rigid roofing" fire test was passed.

C) Weathering behavior

Comparison Example 26

The material not according to the invention from comparison example 25 underwent a practical test. To this end, a double garage was covered with 1200 mm wide sheets with the coating facing outwards. Degussa Kombiset 3200 and 3206 were used for this purpose. All the sheets were sealed with Tesametal and adhesive tape.

The covered garage was observed over a period of 1 year. After about 6 months, the sheets turned white from the edge inwards due to the wick effect. After about 1 year, complete delamination of the fabric from the sheet surface was observed. In particular, in spite of the sheets being tensioned in profile, the laminated fabric layer came away completely in some cases, for example, fabric layers were blown away completely by a strong wind.

Comparison Example 27

Hot storage. Specimens were cut out of a laminated SDP sheet made of comparison example 25 and stored for 5 hours at 60° C. After 5 hours, the laminated glass fibre fabric had become detached from the PVC coating over the entire surface (complete delamination) on all the specimens.

The material failures observed in comparison examples 26 and 27 are not to be expected in the structure according to the invention. As the woven fabric or non-woven in the subject of the invention is not exposed to direct weathering when installed, this minimizes the water absorption and wick effect of the bond. As there is hardly any contact with water and the bond is usually protected from UV radiation by UV-impermeable support material, the weathering behavior is substantially improved in the case of sheets according to the invention.

Further advantages and embodiments may be derived from the patent claims below.

What is claimed is:

1. A light-admitting component mounted as a rigid roofing material on a structure comprising a sheet of polyvinylchloride or polycarbonate having an under side and an upper side exposed to weathering, the under side not exposed to weathering having a layer with a non-combustible material that is resistant to flying sparks and radiant heat such that said light admitting component meets the requirements of DIN 4102, Part 7.

2. A component according to claim 1, wherein the sheet is a webbed or compact sheet.

3. A component according to claim 1 or 2, wherein the material of the layer is a woven fabric or non-woven.

4. A component according to one of claim 1 or 2, wherein the layer comprises a material coated or impregnated with a thermoplastic at least on the side of the material facing the sheet.

5. A component according to one of claim 1 or 2, wherein the sheet is laminated with a weather-resistant film on the upper side exposed to weathering.

6. A component according to claim 3, wherein the woven fabric or non-woven is composed of glass fibres and bears a layer of acrylate, polyurethane or polyvinylchloride at least on the side of the material facing the sheet.

7. A component according to claim 1 or 2, wherein there is a layer of adhesive between the layer with a non-combustible material and the sheet surface.

8. A component according to claim 3, wherein the layer comprises a material coated or impregnated with a thermoplastic at least on the side of the material facing the sheet.

9. A component according to claim 3, wherein the sheet is laminated with a weather-resistant film on the upper side exposed to weathering.

10. A component according to claim 4, wherein the sheet is laminated with a weather-resistant film on the upper side exposed to weathering.

11. A component according to claim 3, wherein the woven fabric or non-woven comprises glass fibres and the layer is acrylate, polyurethane or polyvinylchloride.

12. A component according to claim 11, wherein the sheet is laminated with a weather-resistant film on the upper side exposed to weathering.

13. A component according to claim 3, wherein there is a layer of adhesive between the layer and the sheet surface.

14. A component according to claim 4, wherein there is a layer of adhesive between the layer and the sheet surface.

15. A component according to claim 5, wherein there is a layer of adhesive between the layer and the sheet surface.

16. A component according to claim 6, wherein there is a layer of adhesive between the layer and the sheet surface.

17. A component according to claim 8, wherein there is a layer of adhesive between the layer and the sheet surface.

18. A component according to claim 9, wherein there is a layer of adhesive between the layer and the sheet surface.

19. A component according to claim 10, wherein there is a layer of adhesive between the layer and the sheet surface.

20. A component according to claim 11, wherein there is a layer of adhesive material between the layer and the sheet surface.

21. A component according to claim 12, wherein there is a layer of adhesive material between the layer and the sheet surface.

* * * * *